US006588619B2

(12) United States Patent
Cardarelli

(10) Patent No.: US 6,588,619 B2
(45) Date of Patent: Jul. 8, 2003

(54) TENNIS BALL CONTAINER SAFETY SHIELD

(76) Inventor: Venanzio Cardarelli, 20 N. Triangle Dr., Plymouth, MA (US) 02360

( * ) Notice: Subject to any disclaimer, the term of this patent is extended or adjusted under 35 U.S.C. 154(b) by 0 days.

(21) Appl. No.: 10/050,985

(22) Filed: Jan. 18, 2002

(65) Prior Publication Data

US 2002/0096521 A1 Jul. 25, 2002

Related U.S. Application Data

(60) Provisional application No. 60/262,681, filed on Jan. 22, 2001.

(51) Int. Cl.[7] ..... B65D 17/34; B65D 85/00; B65D 41/32

(52) U.S. Cl. ..... 220/270; 206/315.9; 220/266

(58) Field of Search ..... 220/270, 266, 220/268, 276, 216, 258.2; 206/315.9

(56) References Cited

U.S. PATENT DOCUMENTS 2,465,755 A * 3/1949 Sanders ..... 206/525
3,855,026 A * 12/1974 Fox et al. ..... 156/69
3,883,035 A * 5/1975 Rentmeester et al. ..... 220/270
4,813,837 A 3/1989 Ball et al.
4,890,759 A 1/1990 Scanga et al.
4,930,656 A 6/1990 Blanchette
5,413,241 A 5/1995 Yeh
5,848,650 A 12/1998 Granger et al.

* cited by examiner

*Primary Examiner*—Lee Young
*Assistant Examiner*—James Smalley
(74) *Attorney, Agent, or Firm*—D. Michael Burns

(57) ABSTRACT

A pull-top lid for a pressurized tennis ball container having a rubber safety shield for protecting against injury from the sharp pressing seam edge of the removed lid.

The rubber gasket-like safety shield being bonded to the upper surface of the top enclosure panel and reaching beyond the pressing seam of the lid such that protection against injury is provided by the shield being extended beyond the sharp edge of the sheet metal.

An alternative embodiment having an outer perimeter comprised of an arch shaped extension arm extending across the pressing seam and resting upon the circular lip of the raised rim. The lid upon being pulled off the the top panel synchonously causes the extension arm to wrap about and encapsulate the sharp edge of the pressing seam thereby preventing injury of any body parts.

6 Claims, 2 Drawing Sheets

TENNIS BALL CONTAINER SAFETY SHIELD

CROSS REFERENCE TO RELATED APPLICATION

This application is based on Provisional Patent Application Serial No. 60/262,681 filed Jan. 22, 2001.

BACKGROUND OF THE INVENTION

1. Field of the Invention

The present invention relates to metal or plastic containers, and more particularly, to an end closure for tennis ball containers, and which may have a safe, easy open flip top lid.

2. Description of the Prior Art

Tennis balls are commonly contained in cylindrical plastic or metal containers having a top end closure made of aluminum or tin sheet metal which is provided with a tab for easy opening. There has been a tendency to minimize the thickness or gauge of the sheet material because the cost is a substantial portion of the overall manufacturing cost of the container. In the packaging process, the tennis balls are made from a hollow rubber core with an outer felt material. They are then pressurized with air or other gas, usually to about 14 psi. To avoid leakage prior to use, the container in which they are stored is also pressurized. When opening the container, the flip top tab breaks the pressure seal by perforating the top enclosure. The tab is then used to pull off the enclosure panel. This is made even more difficult because once the seal is broken, the very thin plastic container wall has a tendency to collapse to some degree, thereby making the container somewhat hard to grasp. The edge of the removed lid is very sharp and creates a hazard to the user's fingers. The removed lid is then discarded which can also create an environmental problem.

Some U.S. Patents have sought to provide a safer means of opening flip top containers, and only a few have addressed the dangers encountered with tennis ball containers. U.S. Pat. No. 5,848,690 issued to Granger et al. on Dec. 15, 1998, discloses a tennis ball container with a pressure seal cap and a screw-on top. This idea unfortunately creates the need for a completely redesigned container.

While not designed for tennis ball containers, but relating to flip top open can ends, Yeh discloses in his U.S. Pat. No. 5,413,241 issued on May 9, 1995, an effort to increase the safety by adding a flexible material which is attached to the underside of the sheet material lid and protrudes on a peripheral portion thereof and exceeding the reach of the sheet metal lid. Yeh does not address specifically the unique problems that occur when the tennis ball container is depressed nor the need to have the flexible material on the outer surface of the lid so that it may also be used as a thumb support.

Blanchette, Ball et al., and Scanga et al., U.S. Pat. Nos. 4,930,656, 4,813,837 and 4,890,759 respectively all address the need for improving the safety of flip top containers.

None of the above inventions, taken either singularly or in combination, are seen to describe the instant invention as claimed.

SUMMARY OF THE INVENTION

The present invention relates to a rubber gasket-like safety shield attached to the top surface of a tennis ball container enclosure top. The circular shield having a generally gasket-like flat material which projects over the reach of the pressure seam to provide a shield against injury from the sharp edge of the sheet metal lid. This also provides for a thumb rest when the lid is being removed. The material of choice would be a rubber that would make contact between the lid edge and the fingers very difficult.

A second embodiment would utilize a circular shield having an inner portion fastened to the removable lid and a flexible extension arm arching over the pressing seam of the lid such that when the lid is pulled off from the top enclosure panel, the extension arm wraps about the sharp edge of the pressing seam. The pressing seam defines the lid and prior to the removal of the lid the pressing seam is tentatively connected to a circular lip which extends inwardly from a raised rim on the outer portion of the enclosure panel. The junction of the raised rim and the circular lip defines a crease line. The extension arm has a spherically shaped distal end, which prior to the opening of the container reposes upon the lip at the crease line. Upon the removal of the lid, the spherical distal end slides off the lip and finally wraps about the sharp edge of the pressing seam so as to encapsulate the lid from an possible damage to user's hands and fingers.

An object of the invention is to provide a safety shield against accidental injury to the hands of the user.

Another object of the invention is to provide for an easier means for opening the container.

Still another object of the invention is to provide a solution that does not involve changing the basic structure of plastic tennis ball containers nor their sheet metal top enclosures. The inventive concept of the present invention is accomplished by merely adding with adhesive a rubber or plastic safety shield to an already existing container structure.

Another object of the invention is to provide an inexpensive solution which will not alter the external structural of the enclosure panel of conventional tennis ball containers.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
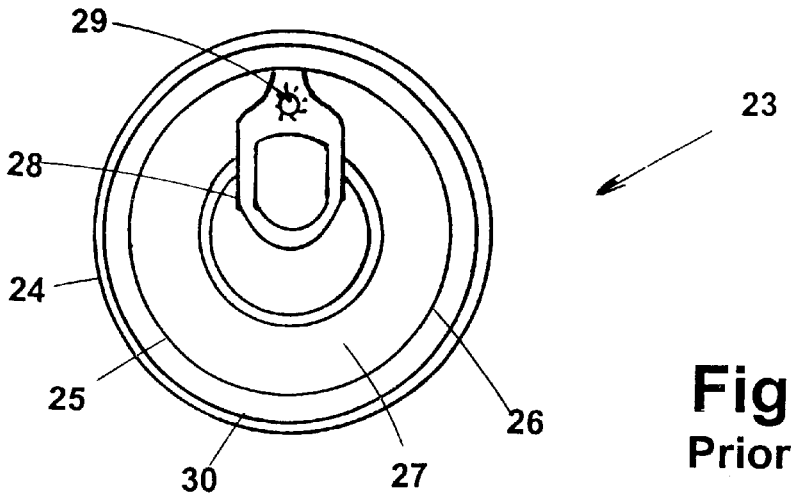
Fig. 2 Prior Art
FIG. 2 is a top plan view of a conventional tennis ball end enclosure of the container shown in FIG. 1.
Figure 1:
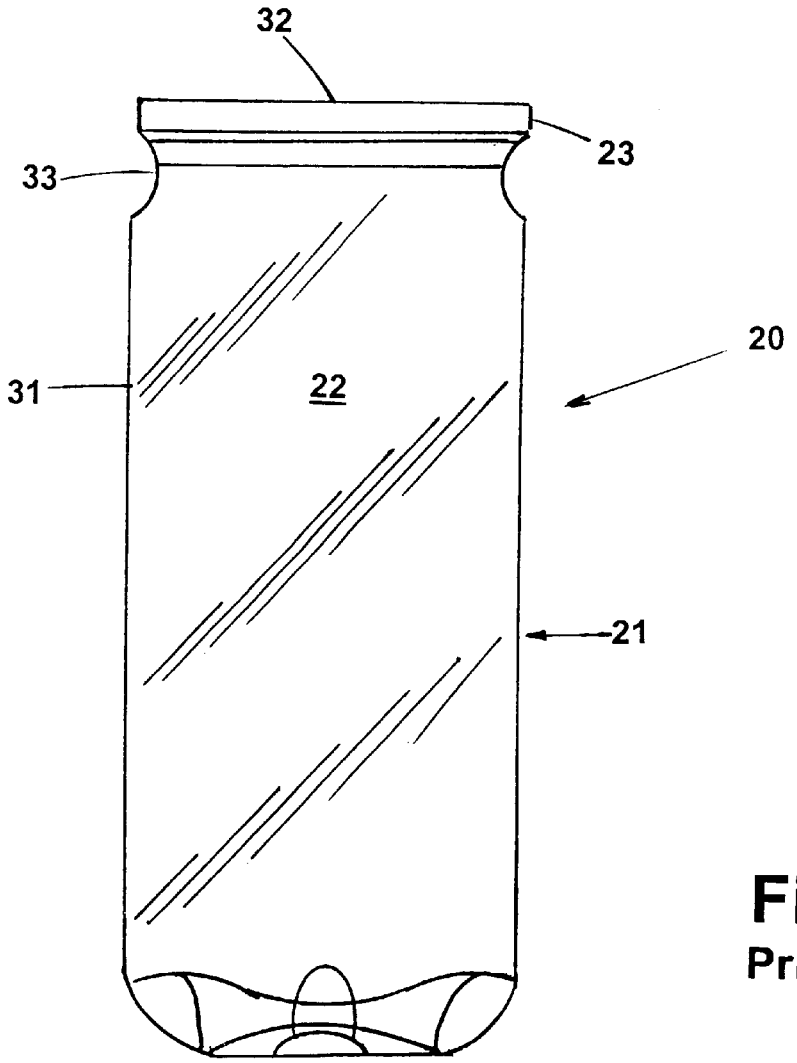
Fig. 1 Prior Art
FIG. 1 is an elevated view of the tubular easy open tennis ball container in accordance with the prior art.
Figure 3:
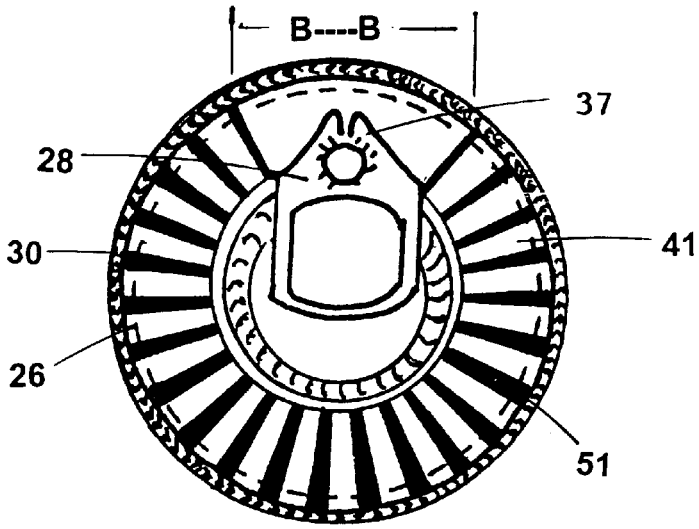
FIG. 3 is a top plan view of a tennis ball container in accordance with the present invention.
Figure 4:
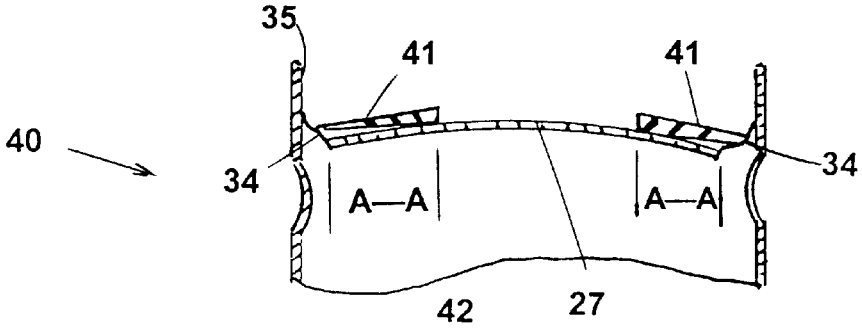
FIG. 4 is a sectional elevational view of the invention as shown in FIG. 3.
Figure 5:
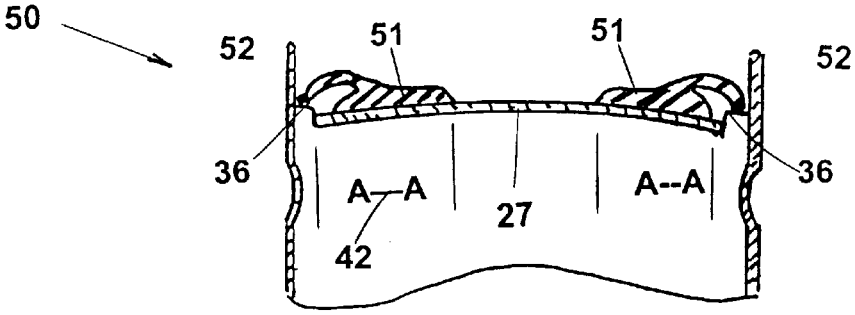
FIG. 5 is a sectional elevational view of the safety shield in accordance with alternate embodiment as shown in FIG. 3.

A conventional tennis ball container 20, as shown in FIGS. 1 to 2, is generally of an elongated tubular construction and typically stores three tennis balls. Tennis balls are manufactured with a hollow rubber core, which is pressurized with air or some other gas to about 14 psi, and then covered with a felt material. The pressurization giving the balls their "bounce". To avoid any gas seepage from the balls, while they are packaged for use, the containers are also pressurized. The body 21 of the containers can be manufactured from plastic or metal, however, plastic is preferred for economic reasons. The container 20 has a pressurized chamber 22 and a top enclosure panel 23. Panel 23 is generally manufactured from aluminum sheet which is extremely thin to keep costs to a minimum. The enclosure panel 23 constitutes a major percentage of the overall cost of tennis ball containers 20. Panel 23, as shown in FIG. 2 has an inner section 24 and an outer section 25. The inner section 24 has a pressing seam 26 about its perimeter, which therein defines a circular removable lid 27. Attached to the upper surface of the lid 27 is a pull tab 28 which is riveted to the lid 27 by a rivet 29. The outer section 25 of the enclosure panel 23 includes a raised rim 30 which serves to integrally connect the plastic wall 31 as shown in FIG. 1. The raised rim 30 remains intact after the lid 27 is removed and provides for a friction fit with a removable plastic cap 32. The sole purpose of the cap 32 is to cover the opening created when the lid 27 is removed and discarded. To enhance an easy off and on of this plastic cap 32, a groove 33 is depressed about the container body 21 to allow a finger tip hold for removal of the cap 32. As seen in FIGS. 3–5, a circular lip 34 is formed on the inner wall 35 of the outer section 24. FIG. 4 describes wherein a junction of the lip 34 and the inner wall 35 defines a crease line 36. The inner perimeter of the lip 34 defining a mating edge with the pressing seam 26 of the removable lid 27.

The user removes the lid 27 by first, pulling the tab 28 upwardly causing a seal breaker 37, located at the distal end of pull tab 28, to perforate the enclosure panel 23, thereby causing a depressurization of the container 20 and the subsequent removal of the lid 27 by a pulling force upwardly away from the container. The lid 27 is then discarded which can cause an environmental problem. However, in pulling the lid 27 off, an immediately harmful situation is exposed to the fingers and hands of the user. To reduce costs, the package is made from an extremely thin metal enclosure panel 23, thus the lid 27 has a razor-like edge. In tennis ball containers this edge is not protected.

The inventive concept of the present invention is best illustrated by FIGS. 3 and 4, wherein FIG. 3 is a top view of the lid 27 of the preferred embodiment container 40. A generally circular rubber gasket-like safety shield 41 is bonded to the top surface of the lid 27 by conventional means such as adhesives at the A—A sites 42. The safety shield 41 is made of a rubber material which reaches beyond the pressing seam 26 and sits on the circular lip 34. When the user removes the lid 27 the rubber shield 41 makes it almost impossible for the user to contact the sharp pressing seam edge 26 with any part of his/her hand. Although the material for has been stated as being of rubber, it would also be feasible to make the shield from a plastic material. The thickness of the shield 41 can be up to the height of the raised rim 30 and yet still not interfer with the friction fit of the plastic cap 32. The area designated by B—B on FIG. 3 is the area wherein there is no safety shield material to allow for penetration of the pull tab 28.

Figure 6:
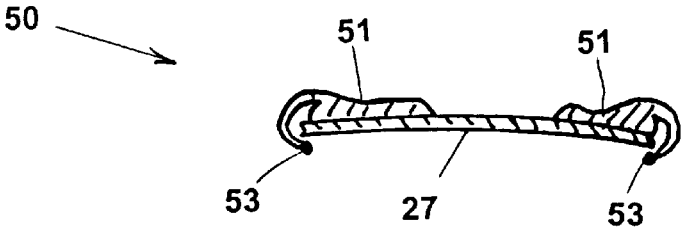
FIG. 6 is a sectional elevational view of the safety shield lid of the alternate embodiment of FIG. 5 with the distal end of the shield encapsulating the lid edge.

An alternative embodiment container 50, depicted by FIGS. 3, 5 and 6 also employs a circular rubber gasket-like shield 51, which is also bonded to the top surface of the lid 27 by conventional means such as adhesives. The cross sectional views of FIGS. 5 and 6 best depict an extension arm 52 of the shield 51 which is arched as it extends over the circular lip 34. The distal end of the extension arm 52 is spherically shaped, which when the container 50 is in an unopened state, as in FIG. 5, the distal end 53 is juxtaposed against the crease line 36. As the user opens the container 50, the lid 27 starts to be pulled away from the top panel 23 along the pressing seam 26, thereby causing the extension arm 52 to slide off the circular lip 34; and then to wrap about and encapsulate the sharp edge of the removed lid 27 (shown in FIG. 6), so as to prevent harm to the user's hands. Although shield 51 can be made from other materials such as plastic, the rubber material with the flexible and resilient extension arm 52 works best. The shield 51 serves another useful purpose as it provides for a thumb rest for the user when the lid 27 is pulled away from the container 40. This is helpful because, as the top panel 23 is perforated, the body 21 of the container 20 collapses due to the release of the pressure from within and the extremely thin plastic material loses its firmness and making it more difficult to grasp the container. The thumb rest also allows for extra leverage.

It is to be understood that the present invention is not limited to the embodiments described above, but encompasses any and all embodiments within the scope of the following claims.

I claim:

1. A cylindrical container comprising:

a removable generally circular lid having a pull tab riveted to its upper surface, the lid having a perimeter comprising of a thin, sharp pressing seam edge; and a substantially circular safety shield bonded to the lid, the shield having an outer perimeter extending over and beyond the pressing seam edge of the lid, the outer perimeter having an arched generally spherically shaped extension arm which upon the lid being pulled off will curl around and encapsulate the sharp pressing seam edge.

2. The container according to claim 1, wherein the container comprises:

a circular lip on its upper, inner wall defining a mating edge with the pressing seam edge; and the spherically shaped extension arm of the safety shield being disposed upon the circular lip, whereby, the shield is in integral contact with the circular lip, only separating as the instant point of contact parts.

3. The container of claim 1, wherein the safety shield is made of rubber material.

4. The container of claim 1, wherein the safety shield is made of a plastic material.

5. The container of claim 1, wherein the safety shield is bonded to the top surface of the lid with adhesive material.

6. The container of claim 1, wherein the container is a tennis ball can.

* * * * *